US006035603A

United States Patent [19]

Focke et al.

[11] Patent Number: 6,035,603

[45] Date of Patent: Mar. 14, 2000

[54] APPARATUS FOR HANDLING OR PRODUCING PACKS

[75] Inventors: Heinz Focke, Verden; Peter Verwiebe, Berlin; Hermann Schnoor, Kirchlinteln-Luttum, all of Germany

[73] Assignee: Focke & Co. (GmbH & Co.), Verden, Germany

[21] Appl. No.: 09/019,050

[22] Filed: Feb. 5, 1998

[30] Foreign Application Priority Data

Feb. 26, 1997 [DE] Germany ..... 197 07 685

[51] Int. Cl.[7] ..... B65B 19/28

[52] U.S. Cl. ..... 53/52; 53/55; 53/507; 53/508; 53/239

[58] Field of Search ..... 53/52, 55, 56, 53/77, 507, 508, 239

[56] References Cited

U.S. PATENT DOCUMENTS

| | | | |
|---|---|---|---|
| 2,640,590 | 6/1953 | McClelland et al. | 209/74 |
| 3,802,325 | 4/1974 | Bardenhagen et al. | 93/39 |
| 3,805,477 | 4/1974 | Kruse et al. | 53/32 |
| 3,956,870 | 5/1976 | Kruse et al. | 53/55 |
| 4,852,335 | 8/1989 | Focke et al. | 53/575 |
| 4,872,258 | 10/1989 | Ragard | 29/740 |
| 4,984,409 | 1/1991 | Focke | 53/53 |
| 5,176,605 | 1/1993 | Focke | 493/31 |

FOREIGN PATENT DOCUMENTS

| | | |
|---|---|---|
| 2320396 | 10/1974 | Germany . |
| 4100239 | 7/1992 | Germany . |
| 388171 | 6/1965 | Sweden . |
| 2196311 | 4/1988 | United Kingdom . |

*Primary Examiner*—Joseph J. Hail, III
*Assistant Examiner*—William Hong
*Attorney, Agent, or Firm*—Sughrue, Mion, Zinn Macpeak & Seas, PLLC

[57] ABSTRACT

Apparatus for handling or producing packs made of packaging material, it being the case that folding elements, pressure-exerting elements, push rods, slides etc. act on blanks of the packaging material. In order to convert any possible incorrect positioning of the moveable elements, in particular of the push rods, immediately into an error signal, a folding turret (10) is assigned a stationary monitoring unit (32) which is equipped with mechanical actuating elements, namely contact lugs (29,30,31). In the event of any possible incorrect positioning, one of the contact lugs (29,30,31) is actuated with the effect of a switching movement.

12 Claims, 7 Drawing Sheets

APPARATUS FOR HANDLING OR PRODUCING PACKS

BACKGROUND OF THE INVENTION

The invention relates to an apparatus for handling or producing packs made of packaging material, such as paper, cardboard, film, etc., having a mobile handling unit, in particular a rotationally driven (folding) turret, and having moveable elements on the handling unit, such as folding elements, pressure-exerting elements, push rods, slides, etc.

An apparatus of this type is a packaging machine or a part thereof, that may also be an arrangement which is provided downstream of a packaging machine, such as a drying turret, in the region of which finished packs harden.

The performance of packaging machines, and in particular of very complex, high-speed cigarette-packaging machines, is influenced considerably by error-induced stoppage times. It is thus important to establish any possible malfunctioning, in particular in the region of the complex folding turret, straight away and then to switch off the packaging machine immediately in order to avoid damage as a result of a malfunction.

SUMMARY OF THE INVENTION

It is thus a concern of the invention to monitor moveable elements of a folding turret or other assembly, in particular folding levers, push rods which can be moved back and forth, etc., for any incorrect positioning, that is to say for deviation from the correct positioning within a movement cycle. Any incorrect positioning which may be established produces an error signal which, depending on the given circumstances, causes the packaging machine to be switched off.

The object on which the invention is based is to propose reliable monitoring of the moveable elements of a packaging machine, this monitoring being effective over the long term, even in unfavourable surrounding conditions, and, in the event of incorrect positioning of the monitored elements, triggering an error signal.

In order to achieve this object, the apparatus according to the invention is characterized in that, in the event of malfunctioning or incorrect positioning of the moveable element, mechanical contact elements can be actuated by the continued movement of the handling unit and thus, as a result of relative movement, produce an error signal.

The monitoring means for moveable elements operates mechanically. Optoelectronic elements, in particular light barriers, which are otherwise generally used for monitoring purposes are avoided as a result of the malfunctioning involved therewith. The (mechanical) monitoring means according to the invention is particularly suitable for packaging machines in which the monitored elements are accommodated wholly or partially in enclosed regions and are constantly supplied with oil or are contained in an oil bath.

According to a further proposal of the invention, a mechanical actuating mechanism for detecting incorrect positioning may be arranged within the enclosed chamber, while signal-triggering elements, for example contactless electrical switching elements (initiators), are located outside this region.

Another concern of the invention is the configuration of push rods of a folding turret such that, in the event of such a push rod being overloaded as a result of malfunctioning, the push rod can be decoupled from a drive. This decoupling results in destructive movements of the push rod being avoided, but also in incorrect positioning of the push rod, which is detected according to the invention.

The invention can be used particularly advantageously for a folding turret for producing cigarette packs of the soft-carton type. Such a folding turret is equipped with a plurality of push rods which can be displaced in the axis-parallel direction in order for a cigarette group to be pushed out of a folding mandrel, with the folded pack blanks arranged on the outside of the folding mandrel being carried along in the process. The invention is concerned with the monitoring of the correct movement back and forth of said push rod.

Further details and features of the invention relate to the design of the push rod and of the drive for the same and to the configuration of the elements for monitoring correct positioning and movement of the push rod and of the means for transmission to switching elements.

BRIEF DESCRIPTION OF THE DRAWINGS

Exemplary embodiments of the invention are explained in more detail hereinbelow with reference to the drawings, in which.

DESCRIPTION OF PREFERRED EMBODIMENTS

The drawings represent a preferred application example, namely a folding turret 10 as part of a packaging machine for producing cigarette packs of the soft-carton type. Further details of the construction and the functioning of such a folding turret 10 can be gathered from DE 196 54 394.0.

The folding turret 10 is provided with folding mandrels 11 along the circumference. These are elongate, thin-walled hollow bodies for receiving a cigarette group. On the outside of the folding mandrel 11, blanks of packaging material are folded one after the other during the rotary movement of the folding turret 10, that is to say, in particular, an inner wrapper made of tinfoil or paper and a carton-like, outer wrapper made of paper.

Figure 1:
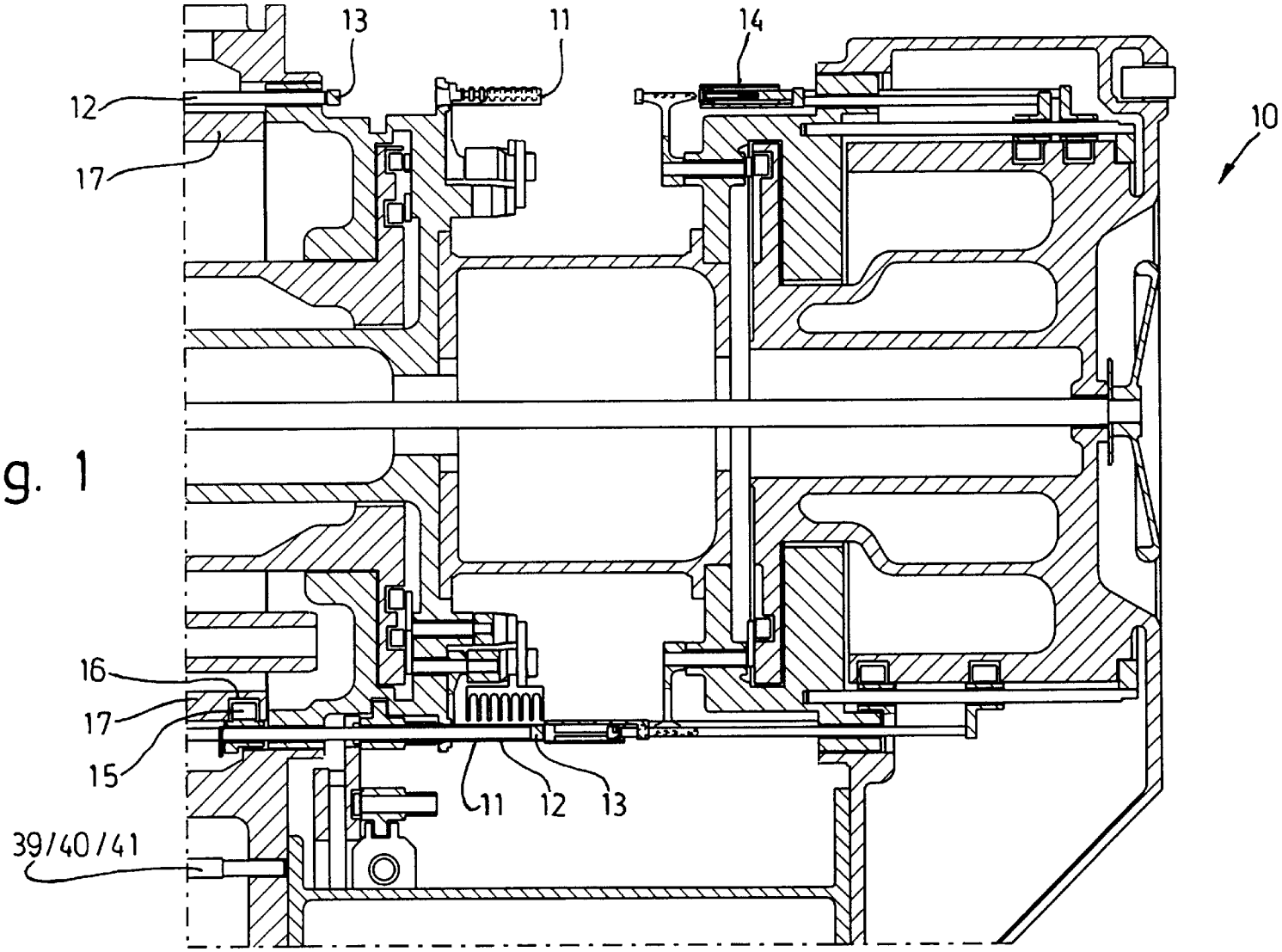
FIG. 1 shows an example of a folding turret, in longitudinal section.
Figure 2:
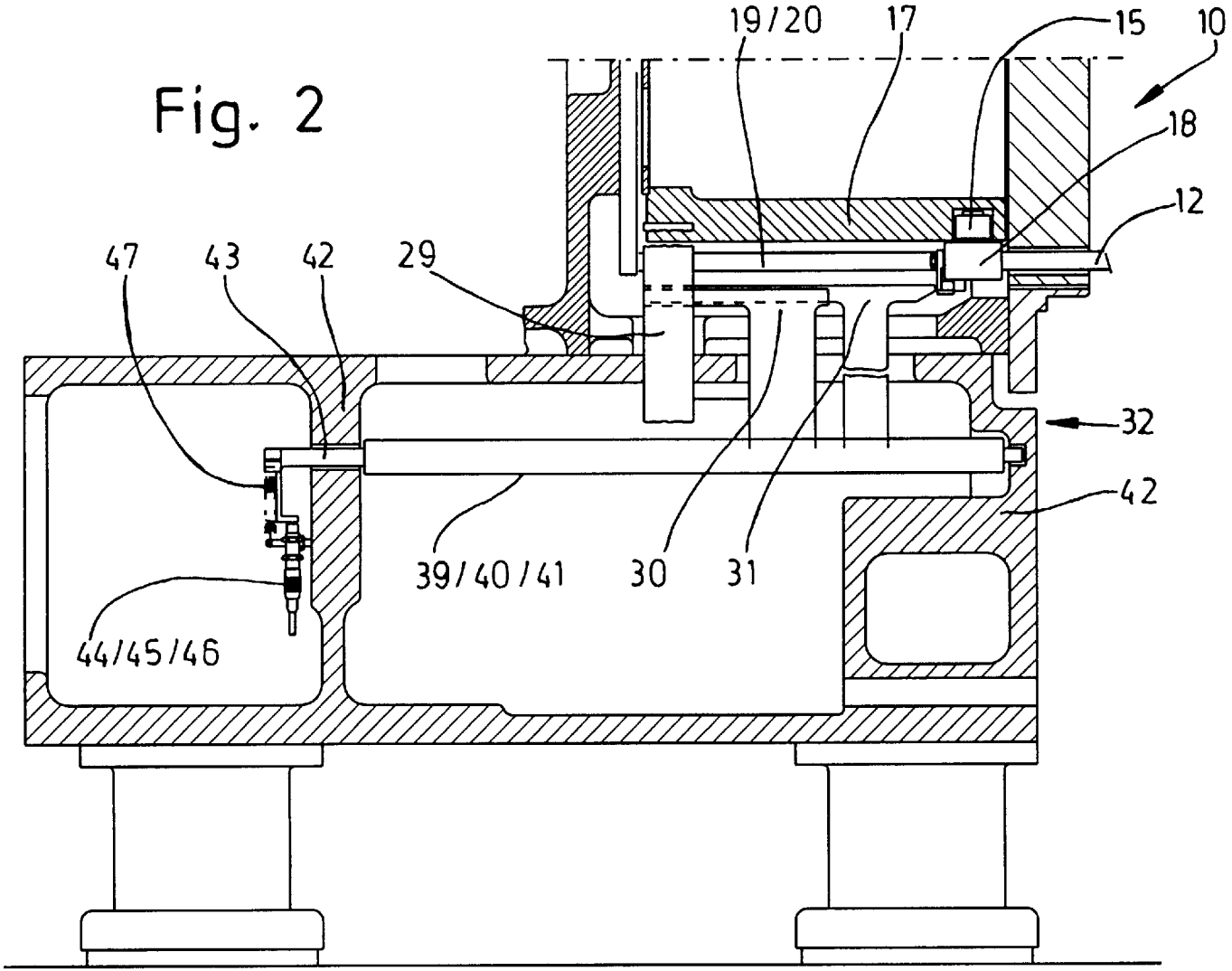
FIG. 2 shows the bottom region of the folding turret, likewise in longitudinal section and on an enlarged scale.
Figure 3:
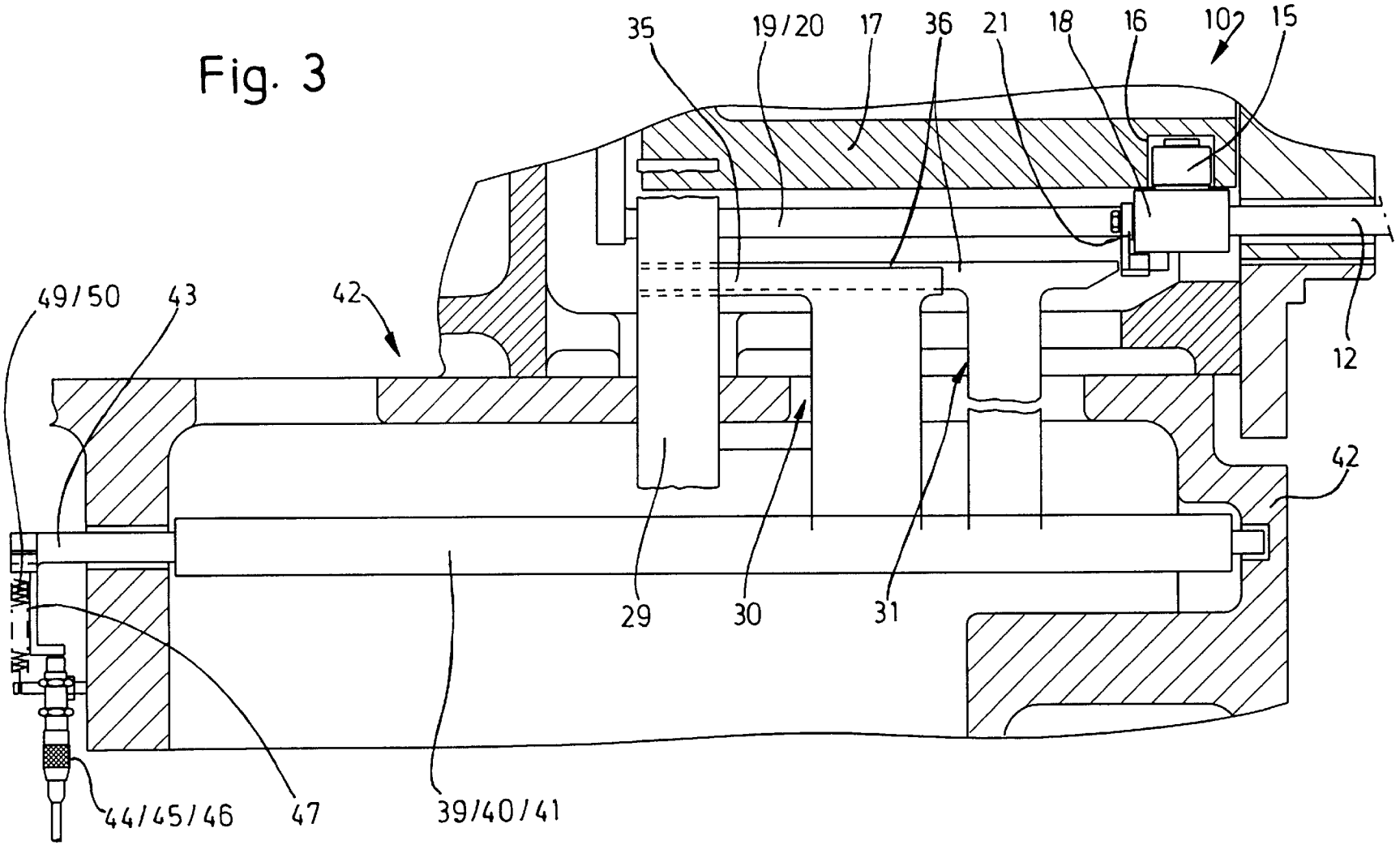
FIG. 3 shows a further-enlarged part of the detail according to FIG. 2, namely a vertical section along section plane III—III of FIG. 4.

Once the necessary folding has been carried out, the unit comprising the cigarette group and the blanks which have been folded partially or completely is pushed out of the folding mandrel 11 or pushed off therefrom. Serving for this purpose are elongate push rods 12 which are mounted in the axis-parallel direction along the circumference of the folding turret 10 and are assigned to each folding mandrel 11. In order for a cigarette group to be pushed out of a folding mandrel 11, with the folded blanks being carried along in the process, the push rod 12 passes, by way of a push-rod head 13, into the folding mandrel 11 via an open side and pushes out the cigarette group, the blanks which butt against the folding mandrel 11 being carried along in the process. The unit comprising cigarette group and blanks is transferred to an adjacent folding pocket 14 of the folding turret 10 and folding is completed in this region. Thereafter, the push rod 12 returns into its initial position (top of FIG. 1) from the pushed-out position (bottom of FIG. 1).

The movements of the push rod 12 back and forth are positively controlled in accordance with the rotary movement of the folding turret 10. An end region of the push rod 12 which is remote from the push-rod head 13 is provided with a transversely directed contact roller 15. During rotation of the folding turret 10, said roller runs in a control groove 16 which, for its part, runs in a fixed part of the folding turret 10, in circumferential direction of the latter, namely in a coaxially mounted control body 17. The control groove 16 is configured such that the contact roller 15 running therein transmits the back-and-forth movement to the push rod 12.

In the present exemplary embodiment, the contact roller 15 is provided laterally on a carriage 18 which, for its part, is connected to the push rod 12. Accordingly, the carriage 18 is moved back and forth with the push rod 12. For this purpose, the carriage 18 is guided, to be precise on two spaced-apart parallel guide rods 19,20.

The push rod 12 runs centrally between the two guide rods 19,20.

In the present case, the carriage 18 serves as a releasable coupling between the contact roller 15 and push rod 12. For this purpose, the carriage 18 itself is mounted displaceably on the push rod 12. Serving for the purpose of connecting the carriage 18 to the push rod 12 is a crosspiece 21 which is connected to the push rod 12, to be precise at the end of the latter via a connecting screw 22. The plate-like crosspiece 21 is retained in releasable connection with the carriage 18, to be precise via (two) permanent magnets 23,24 in the present exemplary embodiment. The permanent magnets 23,24 are positioned in recesses 25 of the carriage 18 such that, on the side facing the (metallic) crosspiece 21, the permanent magnets 23,24 are approximately flush with the rear side of the carriage 18. The magnetic force of the permanent magnets 23,24 produces the connection between the carriage 18 and the crosspiece 21, and consequently to the push rod 12.

In order to receive the permanent magnets 23,24 and to form the recesses 25, the carriage 18 is provided, on the underside and inside, with an approximately rectangular, centrally arranged extension 26. The latter also serves to ensure precise relative positioning of the push rod 12 with respect to the (guided) carriage 18. This is because the crosspiece 21 is provided on both sides with angled fitting pieces 27,28. These pass in a positively locking manner into angled recesses, formed by the contour of the carriage 18 and of the extension 26, and thus ensure that the push rod 12 is guided in a rotationally secured manner.

The releasable connection of the push rod 12 to its drive, that is to say the contact roller 15, should avoid consequences of malfunctioning, in particular rupturing due to overloading of the push rod 12. If, for example, there is an accumulation of material in the region of the folding mandrel 11, the situation where the push rod 12 or the push-rod head 13 continues to be moved in the axial direction by the positive drive of the contact roller 15, sensitive elements being destroyed in the process, is to be prevented. If a certain pushing force of the contact roller 15 is exceeded, this allows the connecting force of the permanent magnets 23,24 to be overcome. The carriage 18 is released from the push rod 12 and from the crosspiece 21 and is displaced in a sliding manner on the push rod 12 without any transmission of an advancement force, corresponding to the movement of the contact roller 15.

Any possible malfunctioning in the abovedescribed sense, but also other malfunctioning which results in incorrect positioning of a moveable element, is constantly monitored and, as a result of rotation of the folding turret 10, leads to an error display and, consequently, to the packaging machine being switched off. For this purpose, the positioning of the moveable elements—of the push rods 12 in the present case—is carried out by exclusively or predominantly mechanical elements. As a result, the monitoring and/or control means can act in a barely accessible region of the packaging machine or, in particular, in an enclosed region which is supplied with oil.

Figure 4:
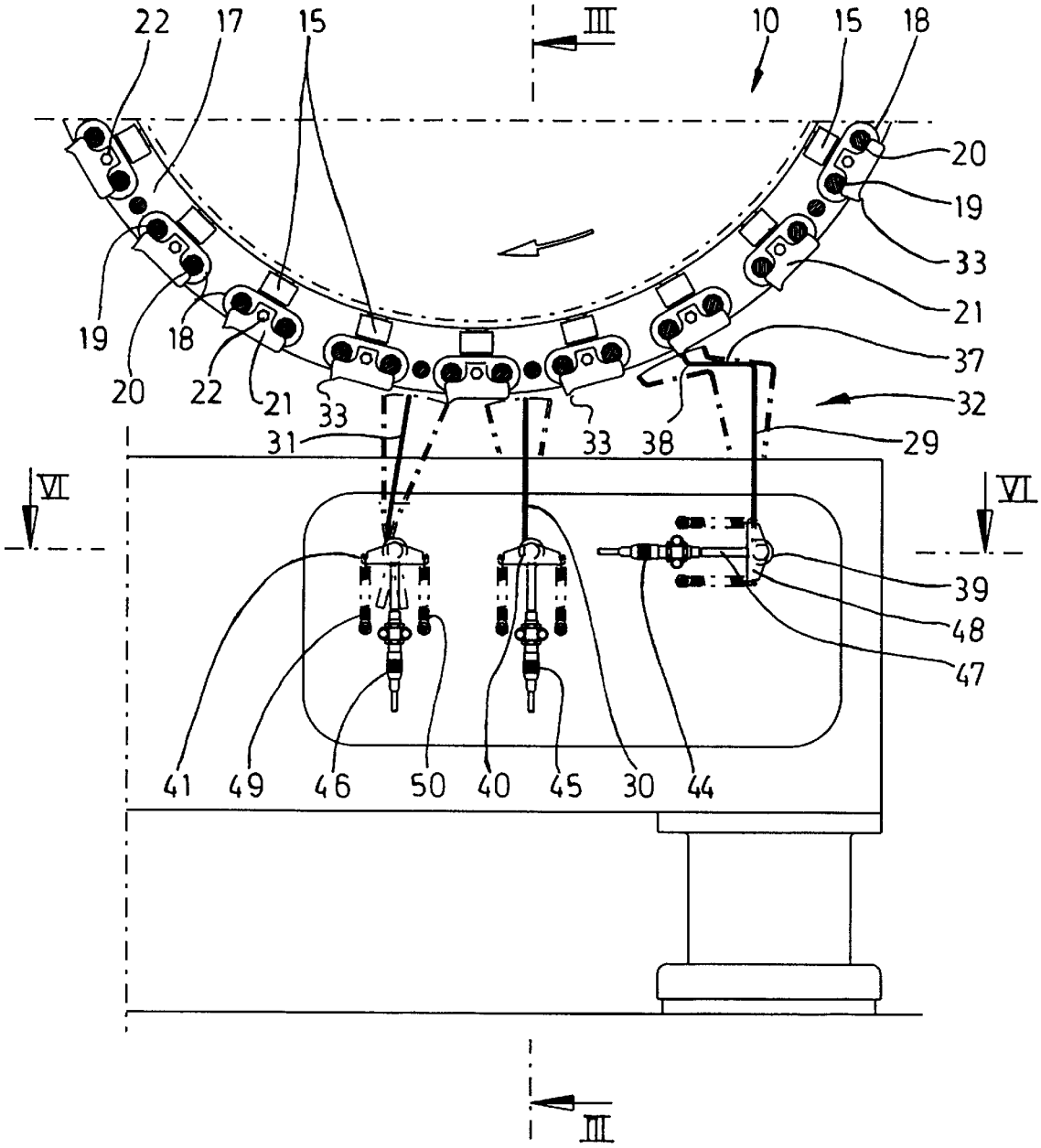
FIG. 4 shows a bottom part of the folding turret, in a section taken transversely with respect to the axial direction, with monitoring elements.

In the event of incorrect positioning of the moveable element, namely of the push rod 12, contact elements which are positioned in the movement path of the push rod 12 are actuated. These are thin-walled contact lugs 29,30,31 made of flat material and are positioned in a stationary manner along the circumference of the folding turret 10. In the present exemplary embodiment (FIG. 4), a monitoring unit 32 comprising three contact lugs 29,30,31 following one after the other in the movement direction is positioned on the outer circumference of the folding turret 10. Actuation of these contact elements or contact lugs 29,30,31 causes an error signal as a result of movement, namely pivoting, of the contact lugs 29,30,31.

Figure 6:
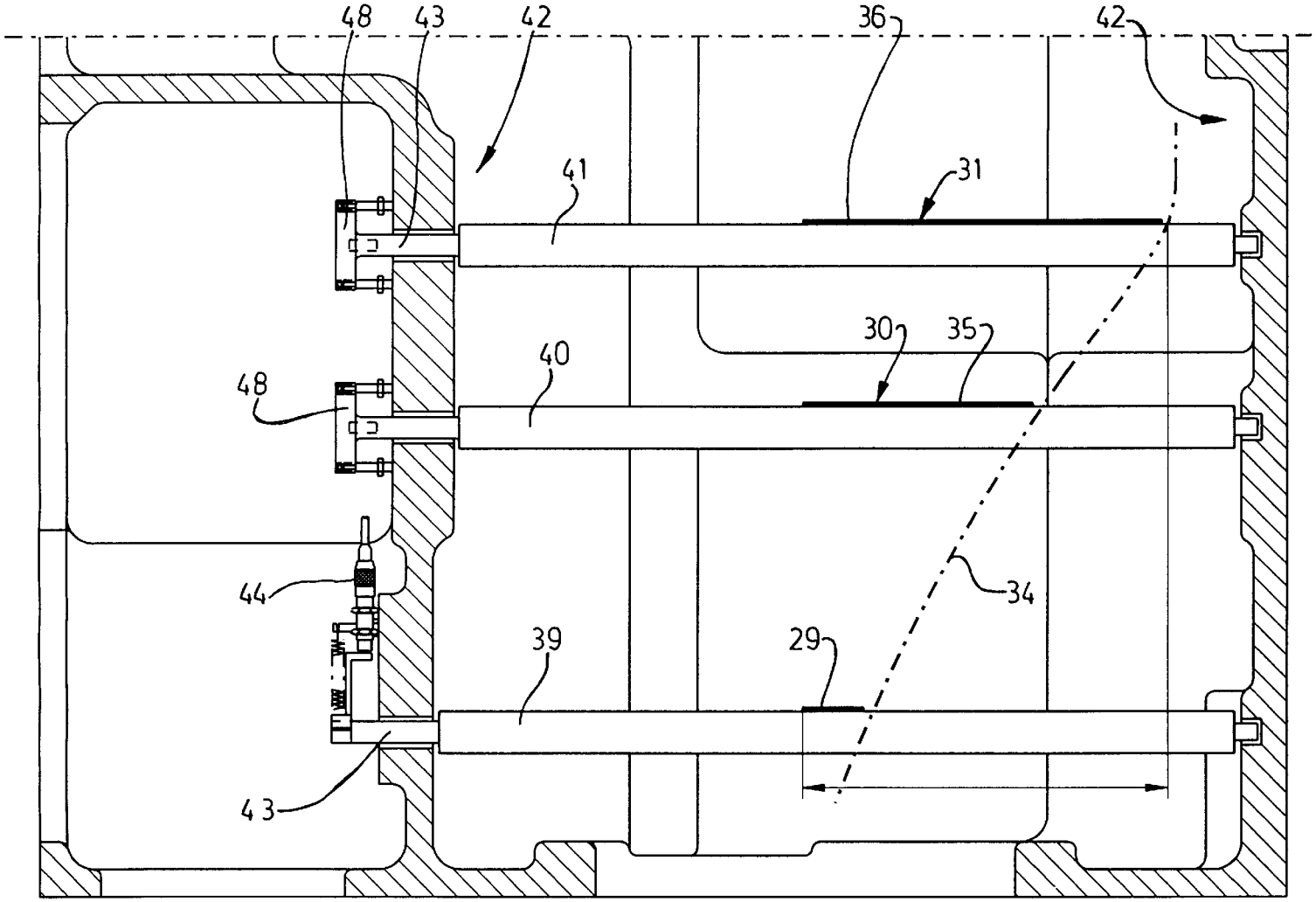
FIG. 6 shows a detail of the illustration according to FIG. 4, namely a horizontal section along section plane VI—VI.
Figure 7:
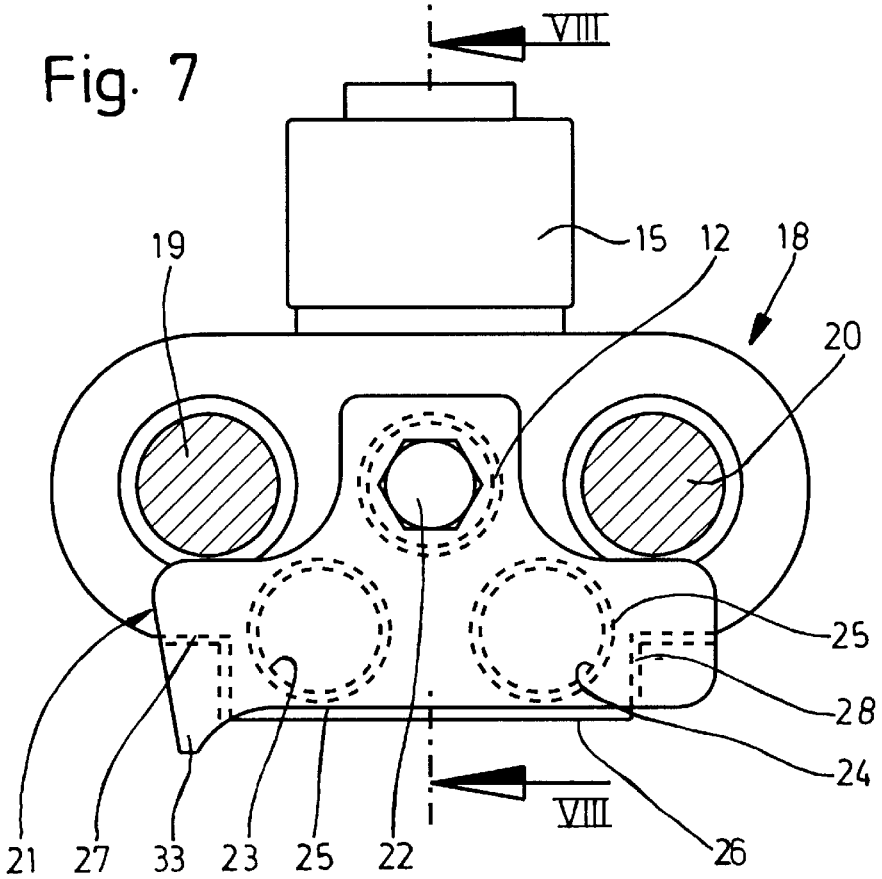
FIG. 7 shows a vastly enlarged detail of a drive for a push rod, in cross-section thereof.
Figure 8:
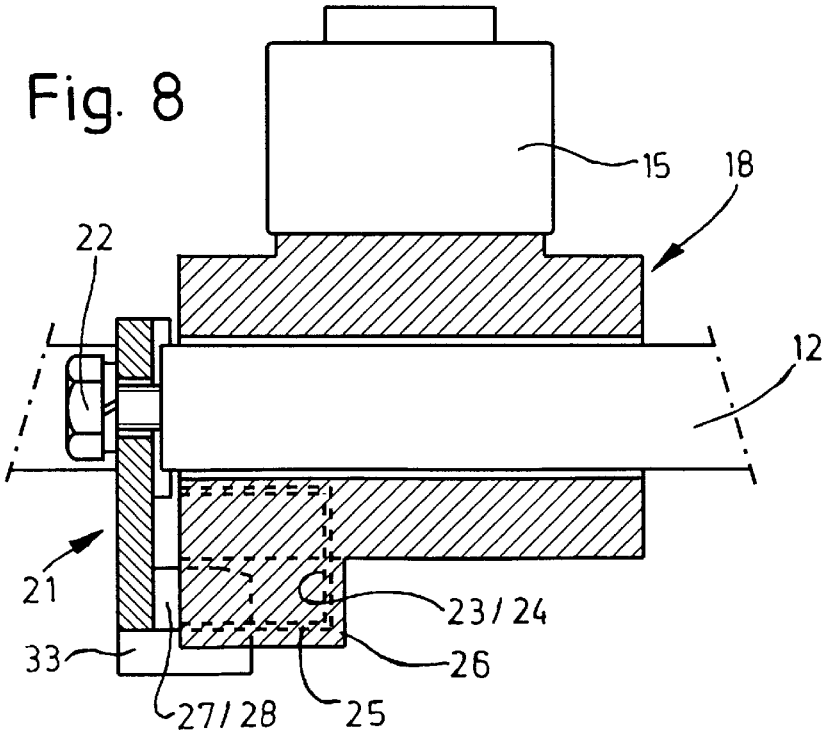
FIG. 8 shows a sectional illustration of FIG. 7 along section plane VIII—VIII.

The contact lugs 29,30,31 are positioned such that, in the event of any conceivable incorrect positioning of the push rod 12, one of the contact lugs 29,30,31 is actuated. That end of the push rod 12 which is remote from the push-rod head 13, to be precise the crosspiece 21, is monitored. Said crosspiece is provided with a protrusion or a radially outwardly directed nose 33, which actuates one of the contact lugs 29,30,31 in the event of incorrect positioning. With the correct movement cycle of the push rod 12, the nose 33, as part of the push rod 12, moves outside the position of the contact lugs 29,30,31. In FIG. 6, the movement path 34 of the nose 33 is shown as a chain-dotted line. If incorrect positioning takes place, the movement path of the nose 33, the result of rotation of the folding turret 10, is offset with respect to the movement path 34, to the left of the latter in FIG. 6. Consequently,—depending on the position of the push rod 12 when the malfunctioning occurs—one of the contact lugs 29,30,31 is reliably actuated by the nose 33 and adjusted for the purpose of triggering a signal. For this purpose, the contact lugs 29,30,31 are designed to be of different widths, in order that all possible relative positions of the nose 33 are taken into account. The first contact lug 29, seen in the direction of rotation of the folding turret 10, is designed as a comparatively narrow material strip, in order to cover the possible positioning of the nose 33 in the region of the initial position of the push rod 12. The first contact lug is followed in the direction of rotation by the contact lug 30, which, in the region facing the folding turret 10 or the movement path of the nose 33, is provided with a strip-like widening 35. The third contact lug 31 extends over the entire movement amplitude of the nose 33, as seen in the axial direction. The contact lug 31 likewise comprises a narrow material strip with a transversely directed widening 36.

All the contact elements or contact lugs 29,30,31 are positioned in the bottom region of the folding turret 10. On account of its laterally offset arrangement, the contact lug 29 is provided with an angled-off section 37, at the end of which there is arranged an angled-off leg 38 for actuation by the nose 33.

The movements of one or other of the contact lugs 29,30,31, triggered in the event of incorrect positioning, are transmitted to switching elements via a mechanical linkage. In the example shown, each contact lug 29,30,31 is connected to a rotatable switching shaft 39,40,41. These switching shafts 39,40,41, which are mounted rotatably at the ends, are mounted in a housing 42 which is open towards the folding turret 10 or the housing thereof. An actuating end 43 of the switching shafts 39,40,41 passes out of the housing 42 via a wall of the same. The switching elements actuated by the switching shafts 39,40,41 are located outside the housing 42.

Figure 5:
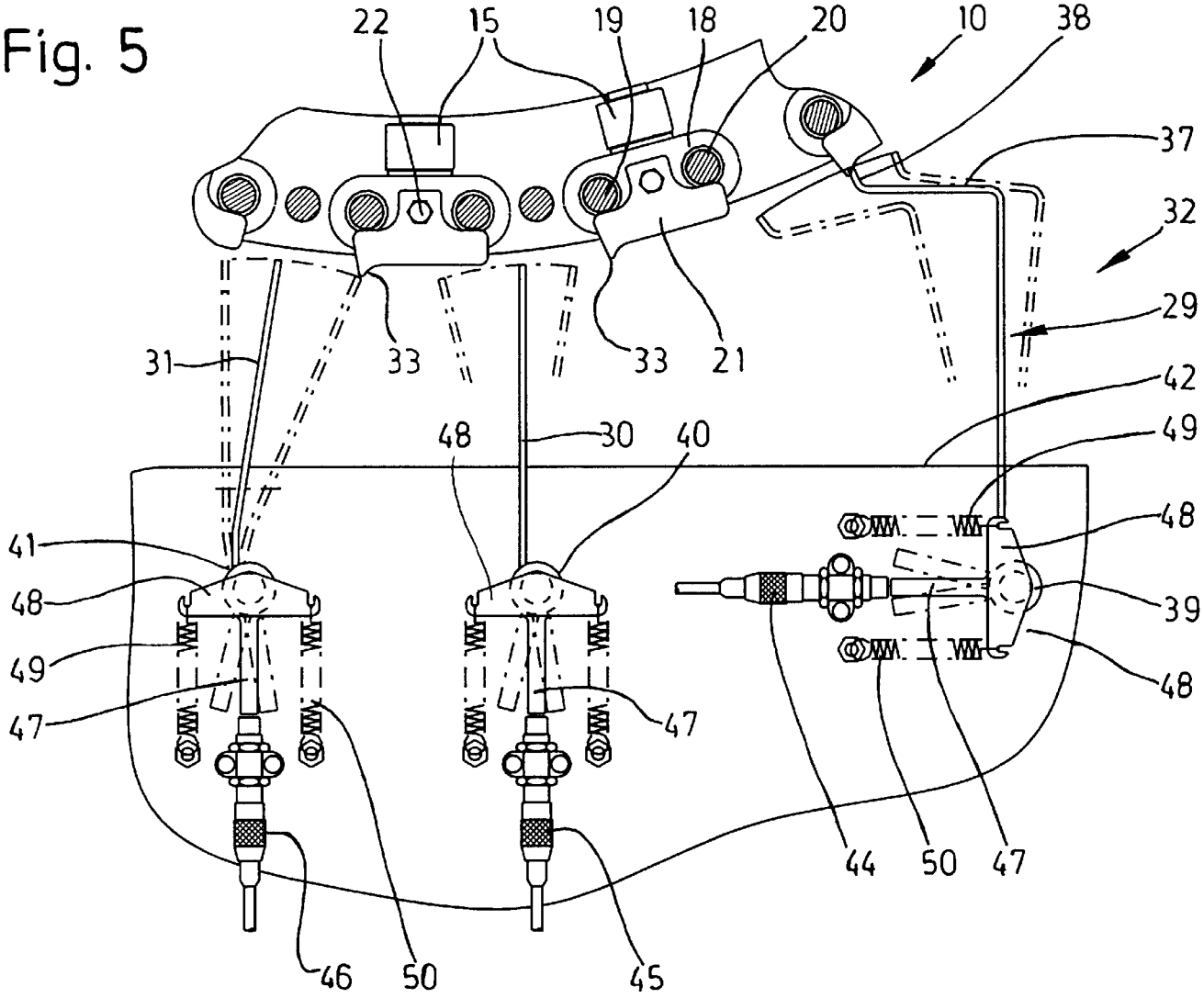
FIG. 5 shows on an enlarged scale, part of the illustration according to FIG. 4.

In the exemplary embodiment shown, contactless switches, namely so-called initiators 44,45,46, are provided as switching elements. These initiators 44,45,46 are actuated by switching levers 47, which move past one end of the initiator 44,45,46 in a contactless manner. In the initial position, the switching levers 47 are directly adjacent to the associated initiator 44,45,46 (position depicted by solid lines in FIG. 5). In the event of an initiator 44,45,46 being actuated as a result of malfunctioning being established, the switching lever 47 is moved into a position outside the direct vicinity of the initiator 44,45,46 (chain-dotted in FIG. 5). This triggers a signal in the initiator 44,45,46, and this signal is sent, for example, to a central computer for evaluation purposes.

The switching levers are arranged, as arms which project on one side, directly at one end, namely at the actuating end 43 of the switching shafts 39,40,41. A rotary movement of one or other of the switching shafts 39,40,41 as a result of actuation of a contact lug 29,30,31 accordingly causes the associated switching lever 47 to pivot in one direction or the other, and thus causes a signal to be triggered.

The actuating mechanism described is provided with a restoring device for movement back into the normal or initial position. For this purpose, in each case transversely directed pivot levers 48 are arranged at the ends of the switching shafts 39,40,41, or at the actuating end 43. Located at the ends of the pivot levers, in turn, are prestressed springs, namely tension springs 49,50, of which the other end is anchored fixedly. The tension springs 49,50 draw the pivot lever 48, and thus the switching shaft 39,40,41 into the normal position (transversely directed position of the pivot lever 48). Accordingly, actuation of the switching lever 47 takes place counter to the loading of the tension springs 49 or 50.

In the event of incorrect positioning of the push rod 12, and thus of the nose 33, the contact lugs 29,30,31 are actuated by said nose. In such a case, the nose 33 is moved against one of the contact lugs 29,30,31 as a result of the relative positioning (FIG. 5), so that said contact lug pivots. This is transmitted in the manner described to the switching element, namely one of the initiators 44,45,46.

The monitoring unit 32 is accommodated predominantly in an enclosed region, with the result that monitoring of the push rods 12 or other elements can also be effected, for example, in a region supplied with oil. In the region of rotatable elements, the transmission mechanisms are led out of the enclosed region, namely out of the housing 42, with the result that appropriate, and sensitive, switching elements are located outside this enclosed region.

The monitoring described may also be used for other elements, for example for pivotable folding elements or other elements. Furthermore, the pressure-controlled actuation of the push rods 12 may also be done in some other manner, that is to say with mechanical latching elements instead of the permanent magnets 23,24.

What is claimed is:

1. An apparatus for transporting packs, comprising:

a mobile conveyor having receptacles for holding the packs:

a plurality of movable elements on the conveyor that are operative for back and forth movement;

means for, during a conveying movement of the conveyor, moving the movable elements into a working position and back to an initial position; and a plurality of mechanical contact elements assigned to the movable elements;

wherein at least one of the movable elements, in the event of an incorrect positioning of the movable element, moves at least one of the mechanical contact elements, and the movement of said contact element transmites via actuating means, to at least one sinsor, an error signal to disconnect the moveable elements from the drive, thereby render the movable element inoperative.

2. The apparatus according to claim 1, wherein:

the mechanical contact elements are contact lugs (29, 30, 31);

the contact lugs (29, 30, 31) are mounted translationally stationary but are pivotable; and the movable element is provided with a protrusion which, in the event of an incorrect positioning of the movable element, moves at least one contact lug (29, 30, 31) as a result of the conveying movement of the conveyor.

3. The apparatus according to claim 2, wherein each contact lug (29, 30, 31) is disposed on an associated rotatably mounted switching shaft (39, 40, 41) in such a way that a movement of the contact lug (29, 30, 31) triggers a rotational movement of the switching shaft (39, 40, 41), thus causing a movement of a corresponding switching lever (47) to produce the error signal.

4. The apparatus according to claim 3, wherein the contact lugs (29, 30, 31) are forced elastically into an initial position by tension springs (49, 50) which act on the switching shaft (39, 40, 41) and to apply a force thereto and thus force the contact lug (29, 30,31) into an intermediate position.

5. The apparatus according to claim 3, wherein the contact lugs (29, 30, 31) and the switching shafts (39, 40, 41) are mounted in a housing (42), and wherein ends (43) of the switching shafts (39, 40, 41) pass through a wall of the housing (42) and are connected outside of the housing (42) to the switching levers (47) for actuating non-contact switches (44, 45, 46).

6. The apparatus according to claim 2, wherein the conveyor is a rotationally-driven folding turret (10), and wherein the movable element is a push rod (12) which is movable back and forth in an axis-parallel direction to the rotational axis of the folding turret (10), and which has on an end thereof a projecting nose (33) which moves with the push rod (12) to move one of the contact lugs (29, 30, 31) when the push rod (12) is incorrectly positioned.

7. The apparatus according to claim 6, further comprising a stationary monitoring unit (32) associated with the folding turret (10) and containing said contact lugs (29, 30, 31) which follow one after the other in the circumferential direction of the folding turret (10), and which have relative positions and dimensions in the axis-parallel direction to cover all incorrect positions of the push rod (12).

8. The apparatus according to claim 6, wherein the nose (33) is on a crosspiece (21) at the end of the push rod (12).

9. The apparatus according to claim 1, wherein the movement of a contact element (29, 30, 31) caused by an incorrect positioning of a movable element is transmitted, via said mechanical actuating means (39, 40, 41), to a switching lever (47) which interacts with and actuates a stationary non-contact switch (44, 45, 46) to generate the error signal.

10. An apparatus for transporting packs, comprising:

a rotationally driven folding turret (10);

movable push rods (12) that are movable back and forth relative to the rotating folding turret (10); a push rod-drive connected to each push rod via a releasable coupling in such a way that when a movable push rod (12) is overloaded, the push rod is disconnected from said drive.

11. The apparatus according to claim 10, further comprising:

a sideways-directed contact roller (15) which moves the push rod (12) and which passes into a stationary control groove (16) such that, as a result of rotation of the folding turret (10), axial movements back and forth are transmitted to the push rod (12), the contact roller (15) being releasably connected to the push rod (12); and a carriage (18) which carries the contact roller (15) and which is connected to the push rod (12) via a coupling which releases if overloaded.

12. The apparatus according to claim 11, wherein the carriage (18) is connected, via permanent magnets (23, 24), to a crosspiece (21) arranged at the end of the push rod (12), such that, in the event of overloading, the carriage (18), which is freely movable on the push rod (12), is released from the crosspiece (21).

* * * * *